US009679754B2

(12) United States Patent
Berkout

(10) Patent No.: US 9,679,754 B2
(45) Date of Patent: Jun. 13, 2017

(54) MASS SPECTROMETER INLET WITH REDUCED AVERAGE FLOW

(71) Applicant: Vadym Berkout, Rockville, MD (US)

(72) Inventor: Vadym Berkout, Rockville, MD (US)

(73) Assignee: Smiths Detection Inc., Edgewood, MD (US)

( * ) Notice: Subject to any disclaimer, the term of this patent is extended or adjusted under 35 U.S.C. 154(b) by 0 days.

(21) Appl. No.: 14/906,129

(22) PCT Filed: Jul. 7, 2014

(86) PCT No.: PCT/US2014/045600
§ 371 (c)(1),
(2) Date: Jan. 19, 2016

(87) PCT Pub. No.: WO2015/009478
PCT Pub. Date: Jan. 22, 2015

(65) Prior Publication Data

US 2016/0181079 A1 Jun. 23, 2016

Related U.S. Application Data

(60) Provisional application No. 61/856,389, filed on Jul. 19, 2013.

(51) Int. Cl.
*H01J 49/24* (2006.01)
*H01J 49/04* (2006.01)
*H01J 49/00* (2006.01)

(52) U.S. Cl.
CPC ..... *H01J 49/0495* (2013.01); *H01J 49/0031* (2013.01); *H01J 49/0422* (2013.01); *H01J 49/0468* (2013.01)

(58) Field of Classification Search
CPC .... H01J 49/0422; H01J 49/0495; H01J 49/24; H01J 49/0013; H01J 49/0031;
(Continued)

(56) References Cited

U.S. PATENT DOCUMENTS 3,500,040 A 3/1970 Padrta
5,485,016 A * 1/1996 Irie ..... H01J 49/0422 250/281

(Continued)

FOREIGN PATENT DOCUMENTS

JP 6302296 A 2/1991

OTHER PUBLICATIONS

Yamashita, M. et al., "Electrospray Ion Source. Another Variation on the Free-Jet Theme", J. Phys. Chem, 1984, 88, pp. 4451-4459.

(Continued)

*Primary Examiner* — David A Vanore
(74) *Attorney, Agent, or Firm* — Advent, LLP

(57) ABSTRACT

An interface configured to transfer ions produced at or near atmospheric pressure conditions into a mass spectrometer for mass analysis is provided. The interface includes a first conduit including an inlet configured to receive a fluid containing the ions and an outlet configured to direct the fluid containing the ions into the mass spectrometer. The first conduit defines a first flow path extending from the inlet to the outlet. The interface includes a pump. The interface includes a second conduit. The second conduit includes an inlet. The second conduit defines a second flow path extending from a location between the inlet and the outlet of the first conduit to an outlet of the second conduit. The pump is configured to divert a portion of the fluid including the ions moving in the first flow path to the second flow path.

22 Claims, 3 Drawing Sheets

(58) Field of Classification Search
CPC .. H01J 49/04; H01J 49/10; H01J 49/26; H01J 49/0404; H01J 49/0027; H01J 49/00; H01J 49/165; H01J 49/004; H01J 49/0409; H01J 49/168; H01J 49/005; H01J 49/0431; H01J 49/0445; H01J 49/0459; H01J 49/105; H01J 49/145; H01J 49/40; H01J 49/4205; H01J 49/4215
USPC ..... 250/288, 282, 281, 289, 430, 287, 290, 250/293, 423 R, 425, 433
See application file for complete search history.

(56) References Cited

U.S. PATENT DOCUMENTS 6,518,581 B1 * 2/2003 Dheandhanoo ..... H01J 49/0422 250/281
8,680,464 B2 * 3/2014 Hashimoto ..... H01J 49/0013 250/282
8,853,627 B2 * 10/2014 Ouyang ..... H01J 49/0495 250/281
8,866,070 B2 * 10/2014 Morokuma ..... H01J 49/0031 250/281
9,006,679 B2 * 4/2015 Morokuma ..... H01J 49/0495 250/282
9,058,967 B2 * 6/2015 Ouyang ..... H01J 49/0495
9,406,492 B1 * 8/2016 Ramsey ..... B01L 3/5027
2008/0116370 A1 5/2008 Speldore
2010/0223979 A1 9/2010 Ploehn et al.
2013/0056633 A1 * 3/2013 Hashimoto ..... H01J 49/0013 250/288
2013/0105683 A1 * 5/2013 Ouyang ..... H01J 49/0495 250/282
2013/0126723 A1 * 5/2013 Ouyang ..... H01J 49/0404 250/282
2013/0146759 A1 * 6/2013 Ouyang ..... H01J 49/0495 250/282
2013/0280819 A1 * 10/2013 Cooks ..... H01J 49/0445 436/173
2014/0138540 A1 * 5/2014 Ouyang ..... H01J 49/0013 250/288
2015/0340218 A1 * 11/2015 Papanastasiou .... H01J 49/0495 250/289

OTHER PUBLICATIONS

Carroll, D. I. et al., Atmospheric Pressure Ionization Mass Spectrometry: Corona Discharge Ion Source for Use in Liquid Chromatograph-Mass Spectrometer-Computer Analytical System, Analytical Chemistry, vol. 47, No. 14, Dec. 1975, pp. 2369-2373.
Takats, Z. et al., Mass Spectrometry Sampling Under Ambient Conditions with Desorption Electrospray Ionization, Science, vol. 306, Oct. 15, 2004, pp. 471-473.
International Search Report—Oct. 22, 2014.
Office Action dated Jan. 22, 2017 for Chinese Appln. No. 201480041000.4.
Extended European Search Report dated Feb. 3, 2017 for European Appln. No. 14826637.2.

* cited by examiner

MASS SPECTROMETER INLET WITH REDUCED AVERAGE FLOW

This patent application claims the benefit of and priority to U.S. Provisional Patent Application No. 61/856,389, filed on Jul. 19, 2013, entitled "Mass Spectrometer Inlet with Reduced Average Flow," which is assigned to the assignee of the present patent application, and which is hereby incorporated herein by reference in its entirety.

BACKGROUND

The present disclosure relates to mass spectrometry and more particularly to atmospheric pressure ionization interfaces for mass spectrometers.

Substances may be analyzed to determine whether the substances contain substances of interest, e.g., illicit substances, dangerous substances, etc. Various types of analysis such as, e.g., mass spectrometry, are conducted under low pressure conditions. However, ions from the substance which will be analyzed are generated at higher pressure conditions, for example, at atmospheric pressure.

A variety of atmospheric pressure ionization methods include electrospray ionization (ESI) (Yamashita, M.; Fenn, J. B., *J. Phys. Chem.* 1984, 88, 4451-4459), atmospheric pressure chemical ionization (APCI) (Carroll, D. I.; Dzidic, I.; Stillwell, R. N.; Haegele, K. D.; Homing, E. C. *Anal. Chem.* 1975, 47, 2369-2373), desorption electrospray ionization (DESI) (Takats, Z.; Wiseman, J. M.; Gologan, B.; Cooks, R. G. Science 2004, 306, 471-473), direct analysis in real time (DART) (Cody, R. B.; Laramee, J. A.; Durst, H. D. Anal. Chem. 2005, 77, 2297-2302), atmospheric pressure Dielectric Barrier Discharge Ionization (DBDI), and electrospray-assisted laser desorption/ionization (ELDI) (Shiea, J.; Huang, M. Z.; Hsu, H. J.; Lee, C. Y.; Yuan, C. H.; Beech, I.; Sunner, J. Rapid Commun. Mass Spectrom. 2005, 19, 3701-3704), etc.

SUMMARY

Systems and methods for analyzing substances, for example substances at ambient conditions, are provided.

In one aspect, an interface is provided. The interface is configured to transfer ions produced in approximately atmospheric pressure conditions into a mass spectrometer for mass analysis. The interface includes a first conduit. The first conduit includes an inlet. The inlet is configured to receive a fluid including the ions. The first conduit includes an outlet. The outlet is configured to direct the fluid including the ions into the mass spectrometer. The first conduit defines a first flow path extending from the inlet to the outlet. The interface includes a pump. The interface includes a second conduit. The second conduit includes an inlet. The second conduit defines a second flow path extending from a location between the inlet and the outlet of the first conduit to an outlet of the second conduit. The pump is configured to divert a portion of the fluid including the ions moving in the first flow path to the second flow path. In one embodiment, a valve is configured to control the flow in the second conduit.

In another aspect, a mass spectrometer system is provided. The mass spectrometer system includes a mass spectrometer including a chamber having an inlet. The mass spectrometer system includes a first pump configured to reduce the pressure in the chamber. The mass spectrometer system includes an interface. The interface includes a first conduit having an inlet configured to receive a fluid including ions to be analyzed by the mass spectrometer system. The first conduit system includes an outlet in communication with the inlet of the chamber. The first conduit defines a fluid flow path having a cross-sectional area. The fluid flow path extends between the inlet and the outlet. The interface is configured to direct at least a first portion of the fluid including ions in the fluid flow path from the outlet into the chamber during a first time period and at least a second portion of the fluid including the ions in the fluid flow path from the outlet into the chamber during a second time period. The interface is configured to regulate the amount of the fluid including the ions in the fluid flow path that is directed into the chamber with the cross-sectional area of the fluid flow path remaining substantially the same during the first time period and the second time period.

In another aspect, a method of transferring ions from a region at approximately atmospheric pressure to a chamber of a mass spectrometer having a reduced pressure is provided. The method includes directing a fluid including ions at a pressure of approximately 760 Torr to an inlet of a first conduit defining a first fluid flow path from the inlet to an outlet. The method includes during a first time period, directing the fluid including the ions from the outlet into a chamber of a mass spectrometer having a pressure of less than 760 Torr. The method includes during a second time period, drawing a portion of the fluid including the ions from the first fluid flow path into a second conduit defining a second fluid flow path, the second fluid flow path extending from between the inlet and the outlet of the first conduit to an outlet of the second conduit and directing the remaining portion of the fluid including the ions into the chamber of the mass spectrometer having a pressure of less than 760 Torr.

In another aspect, a system is provided. The system includes a gaseous ion source at a first pressure. The system includes a mass spectrometer operable at a second pressure. The second pressure is lower than the first pressure. The system includes a conduit between the gaseous ion source and the mass spectrometer through which fluid containing ions from the ion source is configured to flow. The system includes a flow diversion element between the gaseous ion source and the mass spectrometer configured to divert sufficient fluid flow to effect reduction of the pressure in the mass spectrometer to the second pressure.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

BRIEF DESCRIPTION OF THE DRAWINGS

The detailed description is described with reference to the accompanying figures. In the figures, the left-most digit(s) of a reference number identify the figure in which the reference number first appears. The use of the same reference number in different instances in the description and the figures may indicate similar or identical items.

DETAILED DESCRIPTION

Figure 1:
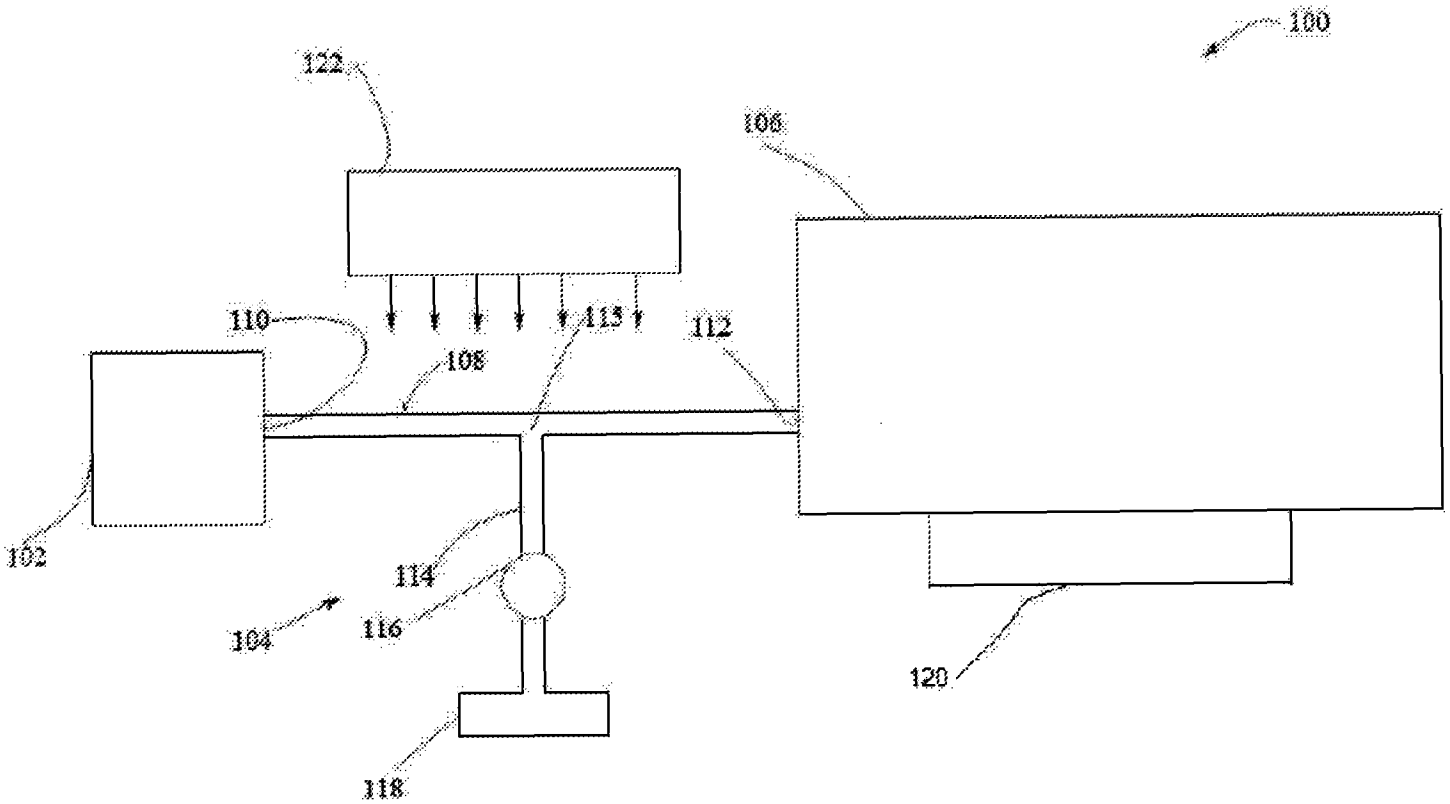
FIG. 1 is a schematic illustration of an embodiment of a system configured to analyze a sample including an ion generation mechanism, an analysis mechanism, and an interface between the ion generation mechanism and the analysis mechanism.

Before turning to the Figures, determining the contents of samples may be useful in many situations. For example, it may be useful to prevent illicit and/or dangerous substances from being transported, e.g., airplane passengers carrying substances e.g., fluids, solids, etc., may need to be checked to determine whether they contain any illicit, dangerous, etc., substances. In another example, it may be useful to analyze substances to determine whether the substances contain impurities, e.g., samples flowing through containers such as conduits, samples stored in containers such as packaging, etc.

Embodiments of analysis systems use various techniques to process substances of interest to produce ions for analysis. Some of these techniques are performed at higher, e.g., atmospheric, pressures. However, in various embodiments, mass analysis, e.g., mass analysis by a mass spectrometer, is performed at lower pressures than the pressures at which the ions to be analyzed are produced. Pressure interfaces may be used to transfer the ions from the higher pressure region where the ions are produced to the lower pressure region where the ions undergo analysis.

Some atmospheric pressure ionization interfaces have a constantly open channel involving a series of differential pumping stages with a capillary or a hole of small diameter to allow ions to be transferred into a first lower pressure stage. In some embodiments, a skimmer restricts access to a second lower pressure stage. Pumps may be used to reduce and maintain the lower pressure in the first and second stages. For example, one pump, e.g., a rough pump, may be used to reduce the pressure in the first region, in one embodiment to approximately 1 Torr. An additional split flow pump or multiple additional pumps, e.g., drag and/or turbomolecular pumps, may be used to lower the pressure in the second stage. Increased numbers of ions being transferred into the second stage for mass analysis may be advantageous.

In various embodiments, increased numbers of ions may be transferred into a region for mass analysis increasing the liquid flow containing ions, e.g., larger entrance capillary, larger orifices between differentially pumped stages, etc. However, ions are introduced into the region for mass analysis along with background fluid (e.g., gas, air, etc.), which is not of interest and not being analyzed. Therefore, increasing the number of ions introduced into, e.g., a mass spectrometer, results in introducing additional fluid into the mass analysis region, raising the pressure of this region. In some situations, increasing the number of ions transferred into the final region for mass analysis may provide the need for large pumping systems to remove the additional fluid allowed to enter the region for mass analysis by, e.g., the larger orifices, etc., used to pass ions from region to region.

However, embodiments of analysis mechanisms sized and configured to be smaller, hand-held, portable, etc., may be advantageous.

In one embodiment, fluid including ions produced at higher pressures is introduced to the lower pressure chamber of a mass spectrometer through an interface. A pump is provided to lower the pressure of the chamber of the mass spectrometer and to maintain the chamber at the desired pressure. Analysis of ions is conducted intermittently and/or discontinuously in the lower pressure chamber of the mass spectrometer. The amount of work that is done by the pump to maintain the lower pressure in the chamber of the mass spectrometer may be reduced by regulating the amount of fluid including ions that is introduced into the lower pressure chamber of the mass spectrometer.

For example, in one embodiment, the mass spectrometer is configured to receive a higher volume of fluid flow during a first time period during which ions are accumulated. The mass spectrometer does not accept ions during a second time period during which the chamber is pumped down (e.g., pressure lowered, fluid removed from chamber). The mass spectrometer also does not accept ions during the time when accumulated ions undergo mass analysis. Thus, the amount of fluid including ions that is introduced into the lower pressure chamber of the mass spectrometer may be reduced during the time period when the mass spectrometer is being pumped down and during the time period during which ions are being analyzed. Doing so may allow for a smaller, lower power, slower, etc., pump to be used to maintain the chamber of the mass spectrometer at the low pressure, in contrast with a constant flow of fluid including ions into the chamber during all times, which may provide advantages for use, for example, with portable mass spectrometer systems. Additionally, during the time period in which ions are being accumulated, higher volumes of fluid, and thus greater amounts of ions, may be injected using embodiments of interfaces as described further below relative to a configuration in which the flow of fluid into the chamber over time is not regulated without, e.g., exceeding the available speed of the pump, requiring a larger, higher speed pump, etc.

With reference to FIG. 1, a schematic representation of an embodiment of an analysis system 100 is illustrated. The system 100 includes an ion generation mechanism 102, an interface 104, and an analysis mechanism 106. The interface 104 extends between the ion generation mechanism 102 and the analysis mechanism 106 and is configured to regulate ion flow between the ion generation mechanism 102 and the analysis mechanism 106.

In one embodiment, the ion generation mechanism 102 includes a chamber at approximately atmospheric pressure. In one embodiment, the chamber is at a pressure of more than approximately 700 Torr. In another embodiment, the chamber is at a pressure of more than approximately 760 Torr. In another embodiment, the chamber is at a pressure of between approximately 650 Torr and approximately 850 Torr. In another embodiment, the chamber is at a pressure of approximately 760 Torr. In another embodiment, the chamber is at a pressure of between approximately 0.5 atmospheres and 2 atmospheres. In another embodiment, the chamber is at a pressure of approximately 1 atmosphere.

The ion generation mechanism 102 receives a substance, e.g., fluid, solid, etc., and uses the substance to produce ions, e.g., ions indicative of the composition of the substance, etc., to be analyzed. In various embodiments, the ion generation mechanism 102 may include, for example, an atmospheric-pressure chemical ion source, an electro-spray ion source, a sonic spray ionization source, atmospheric pressure matrix-assisted laser desorption/ionization, electrospray ionization, nano-electrospray ionization, atmospheric pressure matrix-assisted laser desorption ionization, atmospheric pressure chemical ionization, desorption electrospray ionization, atmospheric pressure dielectric barrier discharge ionization, atmospheric pressure low temperature plasma desorption ionization, and electrospray-assisted laser desorption ionization, etc.

In one embodiment, the interface 104 includes a first conduit 108 extending from an inlet 110 to an outlet 112. The inlet 110 is configured to receive fluid (e.g., gas, air, etc.) including ions from the ion generation mechanism 102. The outlet 112 is configured to direct the fluid including the ions into the analysis mechanism 106. The interface 104 also includes a second conduit 114. The second conduit 114 is in communication with the first conduit 108 at a junction 115 between the inlet 110 and the outlet 112 of the first conduit 108. A valve 116 regulates flow through the second conduit 114. A pump 118 is configured to draw fluid flow through the second conduit 114 when the valve 116 is in an open configuration. The valve 116 is configured to prevent the pump 118 from drawing fluid flow through the second conduit 114 when the valve 116 is in a closed configuration.

In one embodiment, the valve 116 is not located in the first flow path. This may allow for the first conduit to be heated. This also may allow the first flow path to be free from moving elements, which may provide for low maintenance, low contamination, long life of the interface, etc.

In one embodiment, the pump 118 is a scroll pump. In another embodiment, the pump 118 is a diaphragm pump. In other embodiments, the pump 118 may be any suitable type of pump configured to draw fluid through and/or lower the pressure in the second conduit 114.

In one embodiment, the analysis mechanism 106 is configured to receive flow of the fluid including ions to be analyzed from the outlet 112 of the first conduit 108. The analysis mechanism 106 includes a chamber. The analysis mechanism 106 is configured to analyze ions in the chamber. The analysis mechanism 106 includes a pump 120 that is configured to lower the pressure in the chamber of the analysis mechanism 106.

In one embodiment, the pump 120 is a turbo drag pump. In another embodiment, the pump 120 is a scroll pump. In another embodiment, the pump 120 is a diaphragm pump. In other embodiments, the pump 120 may be any suitable type of pump configured to lower the pressure in the chamber of the analysis mechanism 106. In the illustrated embodiment, the analysis mechanism 106 includes a mass analyzer, such as a mass spectrometer configured for mass analysis.

In one embodiment, the pump 120 is configured to reduce the pressure in the chamber of the analysis mechanism 106 to approximately 1 Torr. In another embodiment, the pump 120 is configured to reduce the pressure in the chamber of the analysis mechanism 106 to less than approximate 1 Torr. In another embodiment, the pump 120 is configured to reduce the pressure in the chamber of the analysis mechanism 106 to less than approximately $1\times10^{-2}$ Torr. In another embodiment, the pump 120 is configured to reduce the pressure in the chamber of the analysis mechanism 106 to less than approximately $1\times10^{-3}$ Torr.

The fluid including ions generated in the ion generation mechanism 102 at approximately atmospheric pressure enters into the first conduit 108 through the inlet 110. During a first time period, the valve 116 is in a closed configuration and the sample including the ions is not allowed to pass through the second conduit 114, e.g., all fluid flow including ions flows through the first conduit 108 through the outlet 112, into the low pressure chamber of the analysis mechanism 106 and the ions are collected for subsequent mass analysis. During a second time period, the valve 116 is in an open configuration and a portion of the sample including the ions is drawn from the first conduit 108 and into the second conduit 114 by the pump 118. This portion of the sample is prevented from entering the analysis mechanism 106. During this second time period, the chamber of the analysis mechanism 106 may be pumped down, e.g., fluid without ions to be analyzed may be pumped from the chamber and the pressure of the chamber may be reduced, and/or the captured ions may be analyzed.

In one embodiment, the first time period is less than approximately 20% of the second time period. In another embodiment, the first time period is less than approximately 10% of the second time period. In one embodiment, the first time period is approximately 5% of the second time period. In one embodiment, the first time period is approximately one-tenth of a second and the second time period is approximately one second. In another embodiment, the first time period is less than approximately four-tenths of a second and the second time period is approximately one second. In yet another embodiment, the second time period is more than approximately one second and the first time period is less than approximately one second.

In one embodiment, the first conduit 108 has an inner diameter and defines a flow path having a generally constant cross-sectional area between the inlet 110 and the outlet 112. In another embodiment, the first conduit 108 has a cross-sectional area that varies between the inlet 110 and the outlet 112. However, in one embodiment, the cross-sectional area of the first flow path does not vary over time, e.g., the dimensions of the first conduit 108 are not changed to reduce the amount of fluid that is allowed to pass through the first flow path and out of the outlet 112 into the chamber of the analysis mechanism 106. In one embodiment, this may provide for an interface that has a longer life, requires less maintenance, and may be heated to higher temperatures than, e.g., a conduit whose dimensions are varied to vary the amount of fluid flow that may pass through the first flow path and out of the outlet 112.

The amount of the fluid including ions that is allowed to flow through the first conduit 108 and out of the outlet 112 and into the analysis mechanism 106 is regulated by the operation of the pump 118 and the valve 116 without changing the inner diameter of the first conduit 108 or the cross-sectional area of the flow path defined by the first conduit 108. For example, in one embodiment, the amount of fluid including ions that is allowed to flow through the first conduit 108, out of the outlet 112, and into the analysis mechanism 106 is regulated without deforming, crushing, closing, etc., the first conduit 108. This may provide for a first conduit 108 having an extended workable lifetime. This also may allow the first conduit 108 to be formed from a rigid material configured not to be deformed, crushed, closed, etc. For example, the first conduit 108 in one embodiment may be formed from metal which may be configured to be heated to higher temperatures, e.g., without deformation, degradation, etc.

When the valve 116 is in a closed configuration, in one embodiment, between approximately 0.1 Liters per minute (L/min) and approximately 3 L/min of the sample is configured to flow through the first conduit 108 and into the analysis mechanism 106. In another embodiment, when the valve 116 is in a closed configuration at least approximately 0.3 L/min of the sample is configured to flow through the first conduit 108 and into the analysis mechanism 106.

In one embodiment, regulation of the amount of fluid entering the analysis mechanism 106 is synchronized with the operation of the analysis mechanism 106. For example, in one embodiment, when the analysis mechanism 106 is analyzing previously injected ions, the interface 104 is configured to prevent a portion of the fluid including ions in the first conduit 108 from entering the analysis mechanism 106, e.g., divert a larger portion of the fluid including ions from the first conduit 108 into the second conduit 114. In one embodiment, during an injection period, e.g., when the analysis mechanism 106 is accumulating ions, the interface 104 is configured to allow substantially all of the fluid including ions in the first conduit 108 to enter the analysis mechanism 106, i.e., not to divert a portion of the fluid including ions from the first conduit 108 into the second conduit 114.

In one embodiment, when the valve 116 is in an open configuration, the pump 118 is configured to reduce the pressure in the interface 104 at the junction 115 between the first conduit 108 and the second conduit 114. In one embodiment, when the valve 116 is in an open configuration, the pump 118 is configured to reduce the pressure in the interface 104 at the junction 115 between the first conduit 108 and the second conduit 114 to less than approximately 200 Torr. In another embodiment, when the valve 116 is in an open configuration, the pump 118 is configured to reduce the pressure in the interface 104 at the junction 115 between the first conduit 108 and the second conduit 114 to less than approximately 100 Torr. In another embodiment, when the valve 116 is in an open configuration, the pump 118 is configured to reduce the pressure in the interface 104 at the junction 115 between the first conduit 108 and the second conduit 114 to approximately 50 Torr.

In one embodiment, when the valve 116 is in an open configuration, the pump 118 is configured to divert at least approximately 75% of the fluid including ions travelling through the first conduit 108 into the second conduit 114. In another embodiment, when the valve 116 is in an open configuration, the pump 118 is configured to divert at least approximately 85% of the fluid including ions travelling through the first conduit 108 into the second conduit 114. In another embodiment, when the valve 116 is in an open configuration, the pump 118 is configured to divert at least approximately 95% of the fluid including ions travelling through the first conduit 108 into the second conduit 114.

In one embodiment, when the valve 116 is in an open configuration, the pump 118 is configured such that less than approximately 25% of the fluid including the ions entering the first conduit 108 through the inlet 110 is allowed to flow out through the outlet 112 of the first conduit 108 and into the analysis mechanism 106. In another embodiment, when the valve 116 is in an open configuration, the pump 118 is configured such that less than approximately 15% of the fluid including the ions entering the first conduit 108 through the inlet 110 is allowed to flow out through the outlet 112 of the first conduit 108 and into the analysis mechanism 106. In another embodiment, when the valve 116 is in an open configuration, the pump 118 is configured such that less than approximately 5% of the fluid including the ions entering the first conduit 108 through the inlet 110 is allowed to flow out through the outlet 112 of the first conduit 108 and into the analysis mechanism 106.

In one embodiment, the valve 116 is located in the second conduit and is not located in the flow path defined by the first conduit 108 between the ion generation mechanism 102 and the analysis mechanism 106, e.g., fluid including ions passing into the analysis mechanism 106 will not travel through the valve 116. In one embodiment, the interface 104 does not include any moving parts in the first flow path defined by the first conduit 108. This may provide for reduced contamination of the flow path and the analysis mechanism 106.

With further reference to FIG. 1, in one embodiment, the analysis system 100 also includes a heater 122. In one embodiment, the heater 122 is configured to heat the first conduit 108 to at least approximately 35° Celsius. In another embodiment, the heater 122 is configured to heat the first conduit 108 to at least approximately 50° Celsius. In another embodiment, the heater 122 is configured to heat the first conduit 108 to between approximately 50° Celsius and approximately 150° Celsius. In another embodiment, the heater 122 is configured to heat the first conduit 108 to between approximately 150° Celsius and approximately 300° Celsius. In another embodiment, the heater 122 is configured to heat the first conduit 108 to approximately 300° Celsius. In one embodiment, the portion of the second conduit 114 proximate the first conduit 108 may be heated. In one embodiment, the portion of the second conduit 114 including the valve 116 is not subjected to excessive temperatures.

In one embodiment, the first conduit 108 is formed from metal. In other embodiments, the first conduit 108 may be formed from any other suitable material configured to be heated to at least 100° Celsius without degradation, deformation, excessive wear, etc., on the first conduit 108. Heating of the first conduit 108 may provide for reduction of contamination of the system, e.g., contamination from "dirty" environmental samples, samples having impurities, etc. In one embodiment, heating of the first conduit 108 may prevent carryover effects, e.g., production of ions from previous samples absorbed on the inner surfaces of the first conduit 108. In one embodiment the heater 122 is an electrical heater. In another embodiment, the heater 122 is a convection heater. In another embodiment, the heater 122 is an induction heater. In other embodiments, other suitable heaters may be used.

In one embodiment, the inner diameter of the first conduit 108 is between approximately 0.1 mm and approximately 1 mm. In another embodiment, the inner diameter of the first conduit 108 is between approximately 0.25 mm and approximately 0.6 mm. In another embodiment, the inner diameter of the first conduit 108 is approximately 0.4 mm.

In another embodiment, the second conduit 114 is formed from metal. In one embodiment, the first and second conduits 108 and 114 may be formed from any material or combination of materials that is configured to maintain integrity over time and over varying temperatures.

In one embodiment, a controller is provided. The controller is configured to control the valve 116 to actuate the valve 116 between an open configuration and a closed configuration.

In one embodiment, the second conduit does not include a valve. A controller is provided. The controller is configured to turn the pump 118 on during a first time period to divert a portion of the fluid including ions from the first conduit into the second conduit preventing this portion of the fluid including ions from entering the analysis mechanism when the pump is on. The controller is configured to turn the pump 118 off during a second time period to not divert a portion of the fluid including ions from the first conduit, but to instead allow the fluid including ions to flow through the first conduit and into the analysis mechanism.

In the illustrated embodiment of FIG. 1, the second conduit 114 is illustrated defining a flow path generally perpendicular to the flow path defined by the first conduit 108. In another embodiment, the second conduit defines a flow path extending non-perpendicular to the first conduit. In another embodiment, the second conduit defines a flow path that includes a portion that is generally parallel to the first conduit. In other embodiments, any suitable orientation of the first and second conduits 108 and 114 and the flow paths they define relative to one another may be used.

In one embodiment, the outlet 112 of the first conduit 108 is coupled directly to a mass analyzer. In another embodiment, the outlet 112 of the first conduit 108 is coupled to an intermediate ion storage device, such as, for example, an ion funnel or an ion guide, for example, operated in a trapping mode to trap ions. In another embodiment, the analysis mechanism 106 includes ion guiding devices such as, for example, an ion funnel and/or ion guide located between the outlet 112 of the first conduit 108 and a mass analyzer.

Figure 2:
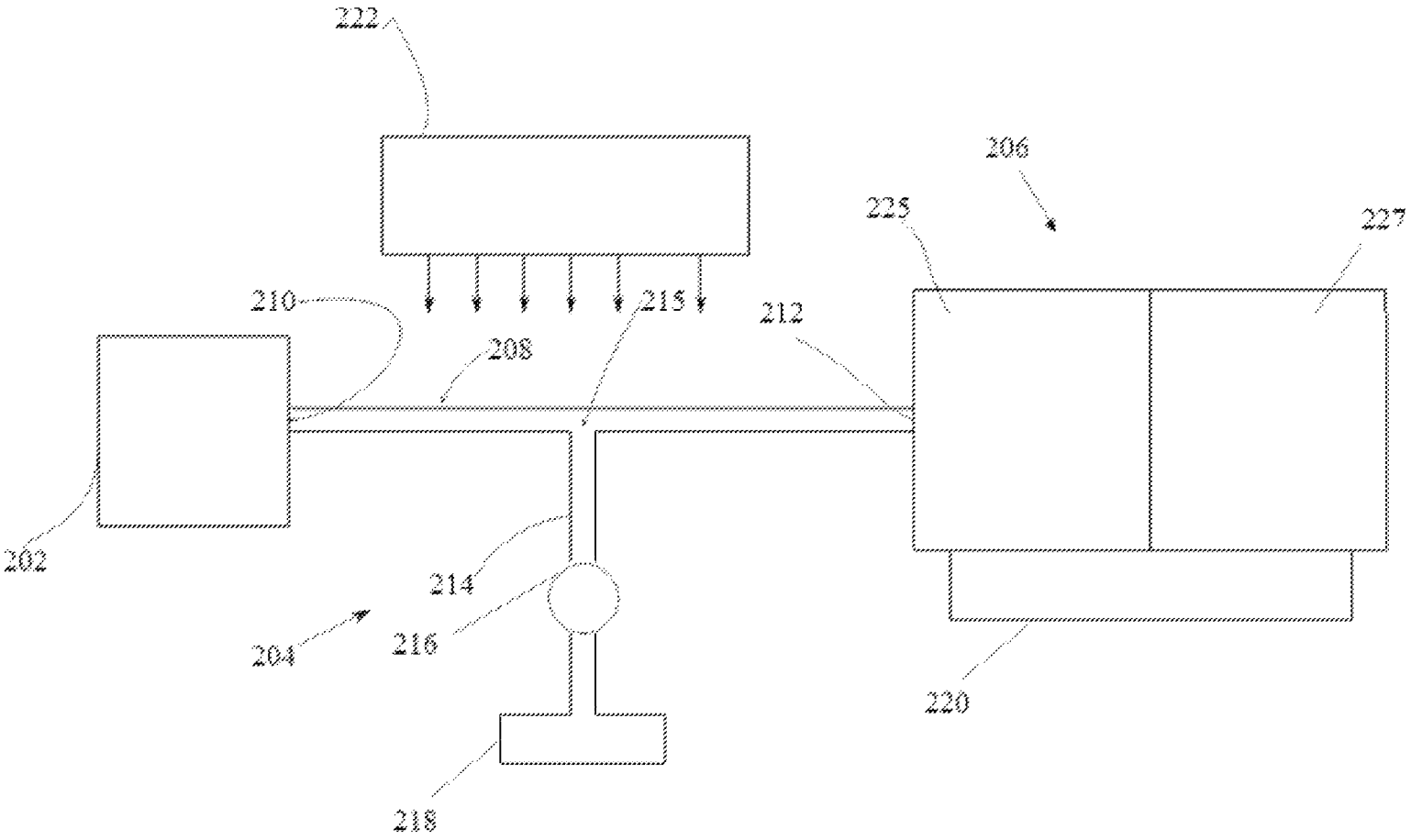
FIG. 2 is a schematic illustration of another embodiment of a system configured to analyze a sample including an ion generation mechanism, an analysis mechanism, and an interface between the ion generation mechanism and the analysis mechanism.

With reference to FIG. 2, another embodiment of a system 200 configured to analyze a sample including an ion generation mechanism 202, an analysis mechanism 206, and an interface 204 between the ion generation mechanism 202 and the analysis mechanism 206. This system 200 has many similarities to the system 100 described above. Therefore, differences are the focus of the description of this system 200. The analysis mechanism 206 of the system 200 includes a first portion 225 including an ion storage device and a second portion 227 in which mass analysis is conducted.

One embodiment of an interface 200 was tested with differentially pumped sections 225 and 227 in the analysis mechanism 206. The first section 225 was connected to the outlet 212 of the first conduit 208. The supply of fluid at the inlet 210 of the first conduit was at approximately atmospheric pressure conditions. With the pump 220 running and the valve 216 closed, i.e., with the whole fluid flow going through the first fluid flow path and out the outlet 212 into the first portion 225 of the analysis mechanism 206, a pressure of 8.2 Torr was measured in the first portion 225 and a pressure of $1.4\times10^{-2}$ Torr was measured in the second portion 227. With a diaphragm pump 218 running and the valve 216 opened for 0.9 seconds and closed for 0.1 seconds periodically, a pressure of 1.0 Torr was measured in the first portion 225 and a pressure of $1.8\times10^{-3}$ Torr was measured in the second portion 227. This indicated that the average intake fluid flow into the analysis mechanism 206 was reduced by about 10 times with the opening of the valve 216 for 90% of each time period.

With reference to FIG. 1, in one embodiment, for a series of time periods of predetermined length, the valve 116 is modulated between an open configuration for a portion of each time period of predetermined length and closed for a portion of each time period of predetermined length. The interface 100 is configured such that when the valve 116 is open for at least approximately 80% of each time period, the pressure in the chamber of the analysis mechanism 106 is less than approximately 20% of the pressure in the chamber of the analysis mechanism when the valve 116 is closed for all of each time period. The interface 100 is configured such that when the valve 116 is open for at least approximately 80% of each time period, the rate of flow of fluid containing ions from the first conduit 108 into the chamber of the analysis mechanism 106 is less than approximately 20% of the rate of flow of fluid containing ions from the first conduit 108 into the chamber of the analysis mechanism 106 when the valve 116 is closed for all of each time period.

With reference to FIG. 2, in one embodiment, for a series of time periods of predetermined length, the valve 216 is modulated between an open configuration for a portion of each time period of predetermined length and closed for a portion of each time period of predetermined length. The interface 200 is configured such that when the valve 216 is open for approximately 90% of each time period, the pressure in the first portion 225 is approximately 10 times less than the pressure in the first portion 225 when the valve 216 is closed for all of each time period. Additionally, the interface 200 is configured such that when the valve 216 is open for approximately 90% of each time period, the rate of flow of fluid containing ions from the first conduit 208 into the analysis mechanism 206 is approximately 10% of the rate of flow of fluid containing ions from the first conduit 208 into the analysis mechanism 206 when the valve 216 is closed for all of each time period.

In one embodiment, the time periods above are between 0.1 seconds and 5 seconds. In another embodiment, the time periods above are between 0.5 seconds and 2 seconds. In another embodiment, the time periods above are approximately 1 second.

In one embodiment, when the valve 216 is in a closed configuration, the pressure in the first portion 225 is between approximately 1 Torr and approximately 30 Torr and the pressure in the second portion 227 is between approximately $1\times10^{-1}$ Torr and approximately $1\times10^{-3}$ Torr. When the valve 216 is in an open configuration, the fluid flow into the analysis mechanism 206 is reduced by between approximately five times and approximately twenty times. When the valve 216 is in an open configuration, the pressures in the first portion 225 and the pressure in the second portion 227 are each reduced by between approximately five times and approximately twenty times.

Figure 3:
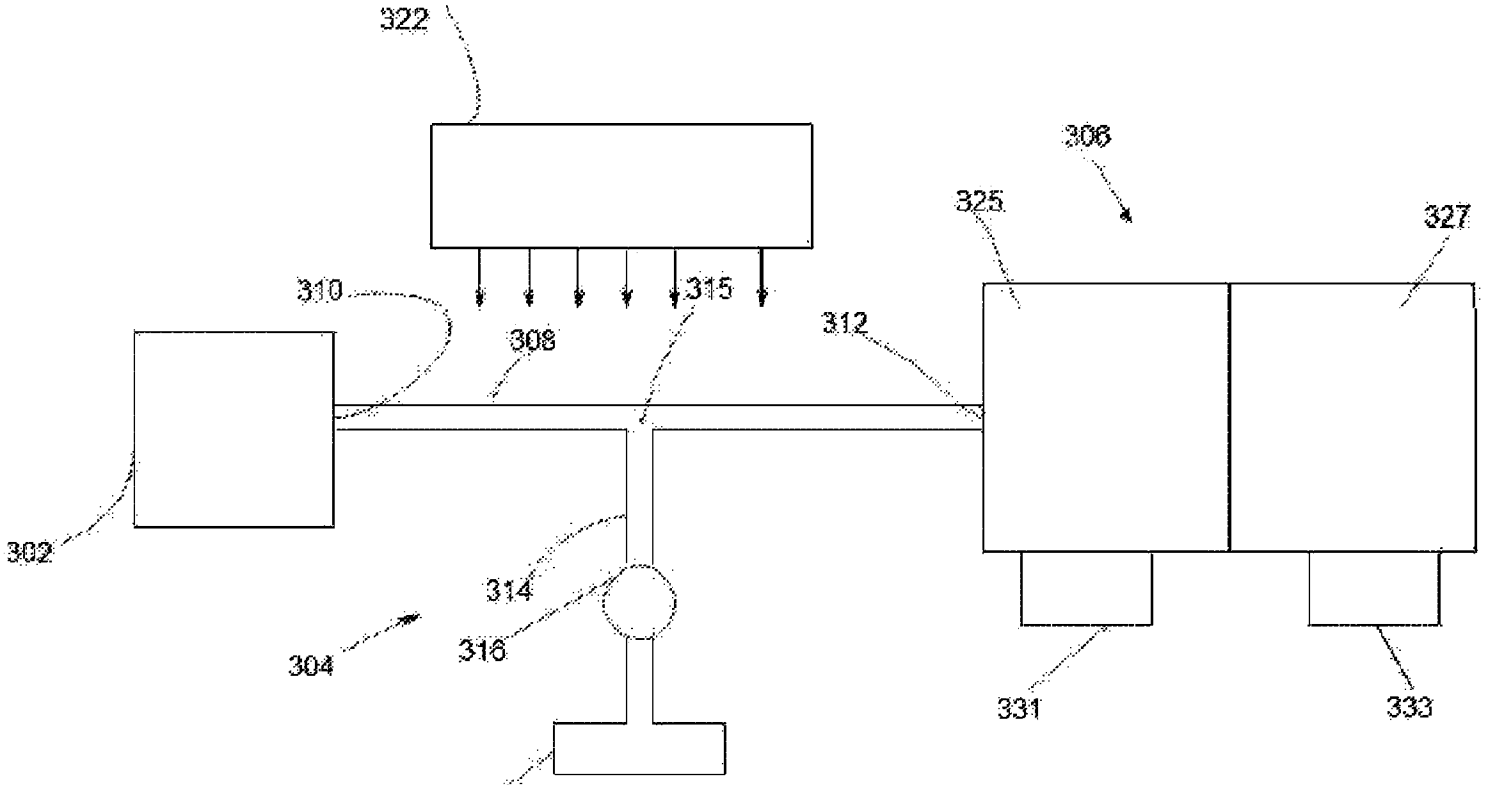
FIG. 3 is a schematic illustration of another embodiment of a system configured to analyze a sample including an ion generation mechanism, an analysis mechanism, and an interface between the ion generation mechanism and the analysis mechanism.

With reference to FIG. 3, another embodiment of a system 300 configured to analyze a sample including an ion generation mechanism 302, an analysis mechanism 306, and an interface 304 between the ion generation mechanism 302 and the analysis mechanism 306. This system 300 has many similarities to the systems 100 and 200 described above. Therefore, differences are the focus of the description of this system 300. The system 300 includes a first lower vacuum pump 331 and a second higher vacuum pump 333. The first lower vacuum pump 331 is configured to reduce the pressure in and remove fluid from the first portion 325 of the analysis mechanism 306. The second higher vacuum pump is configured to reduce the pressure in and remove fluid from the second portion 227 of the analysis mechanism 306.

In various embodiments, the pumps 118, 218, 318 may be configured to pump at speeds of between approximately 0.1 L/min and approximately 10 L/min. In various embodiments, the pumps 118, 218, 318 may be, for example, MVP 006 pumps commercially available from Pfeiffer Vacuum GmbH. In other embodiments, other suitable pumps may be used.

Embodiments of processors may include analog-to-digital converters, digital-to-analog converters, amplification elements, microprocessors, etc., as will be further explained below. Processors are not limited by the materials from which they are formed or the processing mechanisms employed therein. For example, the processor may be comprised of semiconductor(s) and/or transistors (e.g., electronic integrated circuits (ICs)). Memory can be included with the processor. Memory can store data, such as algorithms configured to compare. Although a single memory device can be used, a wide variety of types and combinations of memory (e.g., tangible memory) may be employed, such as random access memory (RAM), hard disk memory, removable medium memory, external memory, and other types of computer-readable storage media.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

In additional embodiments, a variety of analytical devices may make use of the structures, techniques, approaches, and so on described herein. A variety of analytical instruments may make use of the described techniques, approaches, structures, and so on. These devices may be configured with limited functionality (e.g., thin devices) or with robust functionality (e.g., thick devices). Thus, a device's functionality may relate to the device's software or hardware resources, e.g., processing power, memory (e.g., data storage capability), analytical ability, and so on.

In embodiments, the system, including its components, operates under computer control. For example, a processor included with or in the system to control components and functions described herein using software, firmware, hardware (e.g., fixed logic circuitry), manual processing, or a combination thereof. The terms "controller" "functionality," "service," and "logic" as used herein generally represent software, firmware, hardware, or a combination of software, firmware, or hardware in conjunction with controlling the system. In the case of a software implementation, the module, functionality, or logic represents program code that performs specified tasks when executed on a processor (e.g., CPU or CPUs). The program code may be stored in one or more computer-readable memory devices (e.g., memory and/or one or more tangible media), and so on. The structures, functions, approaches, and techniques described in this document can be implemented on a variety of computing platforms having a variety of processors.

Memory can be included with the processor. The memory can store data, such as a program of instructions for operating the system (including its components), data, and so on. Although a single memory device can be used, a wide variety of types and combinations of memory (e.g., tangible memory, non-transitory) may be employed, such as random access memory (RAM), hard disk memory, removable medium memory, external memory, and other types of computer-readable storage media.

Although this disclosure has described embodiments in a structural manner, the structure and its structural and/or functional equivalents can perform methods.

Variations of the embodiments disclosed in this document will be apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

Although the invention has been described in language specific to structural features and/or methodological acts, it is to be understood that the invention defined in the appended claims is not necessarily limited to the specific features or acts described. Rather, the specific features and acts are disclosed as example forms of implementing the claimed invention.

What is claimed is:

1. An interface configured to transfer ions produced in approximately atmospheric pressure conditions into a mass spectrometer for mass analysis comprising:

a first conduit including an inlet configured to receive a fluid including the ions and an outlet configured to direct the fluid including the ions into the mass spectrometer, the first conduit defining a first flow path extending from the inlet to the outlet;

a pump; and a second conduit including an inlet, the second conduit defining a second flow path extending from a location between the inlet and the outlet of the first conduit to an outlet of the second conduit;

wherein the pump is configured to divert a portion of the fluid including the ions moving in the first flow path to the second flow path.

2. The interface of claim 1, comprising a valve located in the second flow path;

wherein when the valve is in an open configuration, the valve allows a portion of the fluid including ions to be diverted from the first flow path to the second flow path by the pump;

wherein when the valve is in a closed configuration, the valve does not allow a portion of the fluid including ions to be directed from the first flow path to the second flow path; and wherein the mass spectrometer includes a chamber at a pressure lower than the pressure at which the ions were produced into which the fluid including the ions is directed by the outlet.

3. The interface of claim 1, wherein the first conduit is a metal conduit; and wherein the first conduit and the second conduit are integrally formed.

4. The interface of claim 3, wherein the first conduit is configured to be heated to at least 50° Celsius.

5. The interface of claim 1, wherein the first flow path defined by the first conduit has a first cross-sectional area; and wherein the first conduit is configured to substantially maintain the first cross-sectional area of the first flow path as the portion of the fluid including the ions is diverted from the first flow path to the second flow path.

6. The interface of claim 1, wherein the pump is configured to divert at least approximately 95% of the fluid including the ions moving in the first flow path to the second flow path.

7. A mass spectrometer system comprising:

a mass spectrometer including a chamber having an inlet;

a first pump configured to reduce the pressure in the chamber; and an interface including a first conduit having an inlet configured to receive a fluid including ions to be analyzed by the mass spectrometer and an outlet in communication with the inlet of the chamber, the first conduit defining a fluid flow path having a cross-sectional area, the fluid flow path extending between the inlet and the outlet, the interface being configured to direct at least a first portion of the fluid including the ions in the fluid flow path into the chamber during a first time period and at least a second portion different than the first portion of the fluid including the ions in the fluid flow path from the outlet into the chamber during a second time period; and wherein the interface is configured to regulate the amount of the fluid including the ions in the fluid flow path that is directed into the chamber with the cross-sectional area of the fluid flow path remaining substantially the same during the first time period and the second time period.

8. The mass spectrometer system of claim 7, wherein the outlet of the first conduit is coupled directly to the inlet of the chamber of the mass spectrometer.

9. The mass spectrometer system of claim 8, wherein the operation of the mass analyzer is synchronized with operation of the interface.

10. The mass spectrometer system of claim 7, wherein the first conduit is metal, the mass spectrometer further comprising a heater configured to heat the first conduit;

wherein the first conduit is configured to be heated to at least 50° Celsius; and wherein the interface includes a second pump, the second pump being configured to prevent a portion of the fluid including the ions from entering the chamber.

11. The mass spectrometer system of claim 7, further comprising at least one of an intermediate ion storage device coupled with the outlet of the first conduit and located between an outlet of the first conduit and a mass analyzer.

12. The mass spectrometer system of claim 10, wherein the interface includes a second pump and a second conduit, the second pump being configured to prevent a portion of the fluid including the ions from entering the chamber; and wherein the second pump is configured to draw a portion of the fluid including the ions flowing in the fluid flow path into the second conduit, reducing the amount of the fluid including the ions entering the chamber.

13. The mass spectrometer system of claim 11, wherein the interface includes a valve configured to regulate the flow of fluid from the first conduit into the second conduit.

14. The mass spectrometer system of claim 7, wherein the inlet is configured to receive the fluid including the ions from an ionizing source that generates the ions in a region at about atmospheric pressure.

15. A method of transferring ions from a region at approximately atmospheric pressure to a chamber of a mass spectrometer having a reduced pressure, the method comprising:

directing a fluid including the ions at a pressure of approximately 760 Torr to an inlet of a first conduit defining a first fluid flow path from the inlet to an outlet;

during a first time period, directing the fluid including the ions from the outlet into a chamber of a mass spectrometer having a pressure of less than 760 Torr; and during a second time period, drawing a portion of the fluid including the ions from the first fluid flow path into a second conduit defining a second fluid flow path, the second fluid flow path extending from between the inlet and the outlet of the first conduit to an outlet of the second conduit and directing the remaining portion of the fluid including the ions into the chamber of the mass spectrometer having a pressure of less than 760 Torr.

16. The method of claim 15, wherein the first conduit is a metal conduit, the method comprising heating the first conduit to a temperature of at least approximately 50° Celsius.

17. The method of claim 15, further comprising reducing the pressure proximate a junction between the first flow path and the second flow path to less than approximately 100 Torr.

18. The method of claim 15, wherein the amount of the fluid including the ions directed into the chamber during the second time period is no more than 5% of the amount of fluid including the ions directed into the chamber during the first time period.

19. The method of claim 15, further comprising producing the ions using one of electrospray ionization, atmospheric pressure chemical ionization, atmospheric pressure matrix assisted laser desorption ionization, thermal ionization, desorption electrospray ionization, atmospheric pressure dielectric barrier discharge ionization, and electrospray-assisted laser desorption/ionization.

20. The method of claim 15, wherein the first fluid flow path defined by the first conduit has a cross-sectional area; and wherein the cross-sectional area of the first fluid flow path is substantially the same during the first time period and the second time period.

21. The method of claim 15, further comprising determining the mass of the ions;

wherein the second time period is synchronized with respect to operation of the mass analyzer.

22. A system comprising:

a gaseous ion source at a first pressure;

a mass spectrometer operable at a second pressure, the second pressure being lower than the first pressure;

a conduit between the gaseous ion source and the mass spectrometer through which fluid containing ions from the ion source is configured to flow;

a flow diversion element between the gaseous ion source and the mass spectrometer configured to divert sufficient fluid flow to effect reduction of the pressure in the mass spectrometer to the second pressure.

* * * * *